US005150668A

United States Patent [19]

Bock

[11] Patent Number: 5,150,668

[45] Date of Patent: Sep. 29, 1992

[54] CYLINDER LINER WITH COOLANT SLEEVE

[75] Inventor: Allyn P. Bock, Chillicothe, Ill.

[73] Assignee: Caterpillar, Inc., Peoria, Ill.

[21] Appl. No.: 838,182

[22] Filed: Feb. 20, 1992

[51] Int. Cl.[5] ..... F02F 1/14

[52] U.S. Cl. ..... 123/41.8; 123/41.84

[58] Field of Search ..... 123/41.79, 41.80, 41.84

[56] References Cited

U.S. PATENT DOCUMENTS

| | | | |
|---|---|---|---|
| 1,845,521 | 2/1932 | Ross | 123/41.8 |
| 1,968,449 | 7/1934 | Hefti | 123/41.8 |
| 2,146,368 | 2/1939 | Dake | 123/41.8 |
| 2,411,924 | 12/1946 | Kratzer | 123/41.79 |
| 3,086,505 | 4/1963 | Bovard | 123/41.8 |
| 3,481,316 | 12/1969 | Olson et al. | 123/41.84 |
| 3,672,263 | 6/1972 | Mirjanic | 92/144 |
| 3,800,751 | 4/1974 | Glassey et al. | 123/41.84 |
| 4,050,421 | 9/1977 | Cendak | 123/41.72 |
| 4,941,440 | 7/1990 | Weber et al. | 123/193 |

FOREIGN PATENT DOCUMENTS 1597584 9/1981 United Kingdom .

*Primary Examiner*—Noah P. Kamen

*Attorney, Agent, or Firm*—Kenneth A. Rhoads

[57] ABSTRACT

Cylinder liners of internal combustion engines must be adequately cooled to obviate oil degradation, carbon packing in the ring area, and piston seizure. The engine includes a block which cooperates with the cylinder liners to define an upper and lower axially spaced coolant chambers. A sleeve is located in a groove defined in the cylinder liner and disposed between the upper and lower coolant chambers. The sleeve and the cylinder liner define a plurality of circumferentially spaced venturi throats. The venturi throats provide a relative long flow path and controls the flow rate of the coolant being communicated from the lower coolant chamber to the upper coolant chamber in order to dissipate heat away from the cylinder liner.

35 Claims, 7 Drawing Sheets

FIG. 8
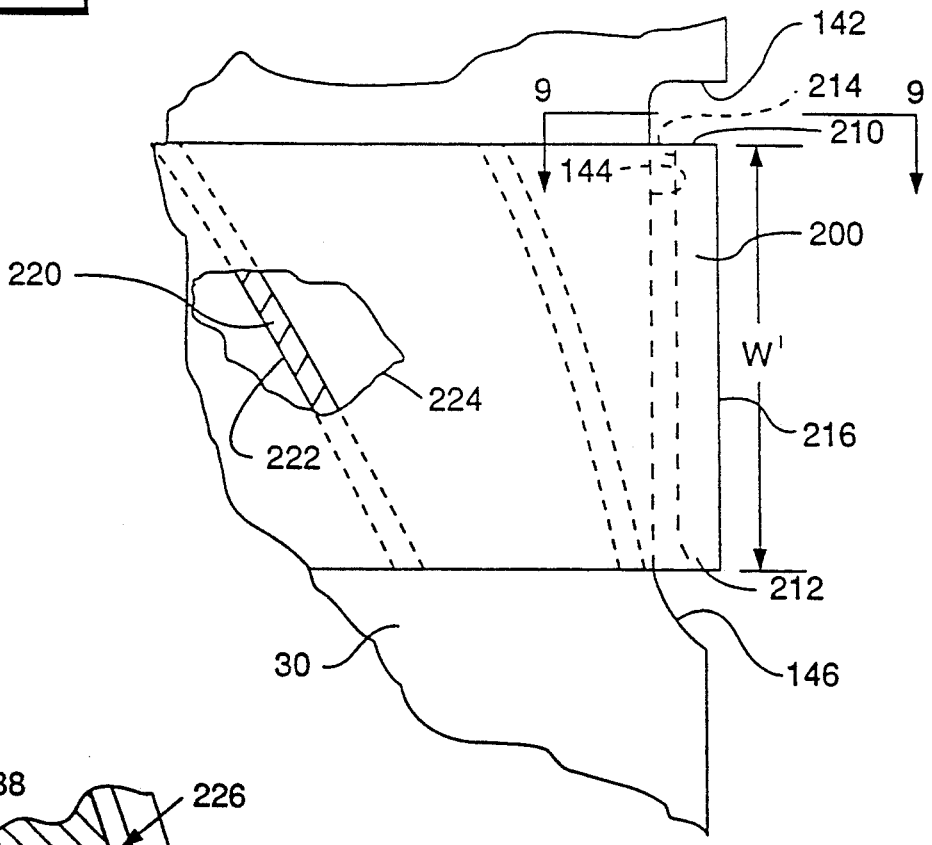
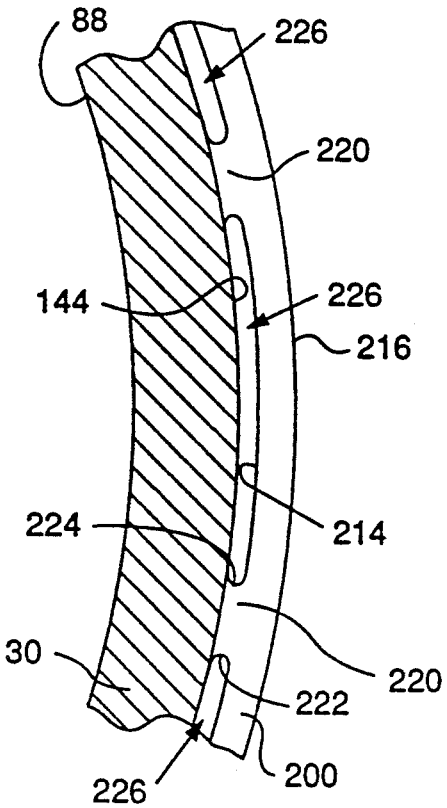
FIG. 9

CYLINDER LINER WITH COOLANT SLEEVE

DESCRIPTION

1. Technical Field

This invention relates generally to a cylinder liner for an internal combustion engine, and more particularly to a cylinder liner including a coolant sleeve capable of reducing the temperature of the cylinder liner and an associated piston assembly during engine operation.

2. Background Art

Constant efforts are being made to improve the construction of piston assemblies of internal combustion engines with emphasis on increased power output per cylinder, improved fuel economy and efficiency, reduced emissions, and a greater service life. Increased engine horsepower have raised the problems of higher cylinder pressures and thermal loads from combustion. In engines utilizing wet cylinder liners, the increased pressures and loads have imposed excessive stress on both the liners and the blocks. Many existing engines have blocks and cylinder liners designed to operate with aluminum piston assemblies generally limited to combustion chamber pressures up to about 12,410 kPa (1800 psi) and with a top ring located a considerable distance from the top surface of the piston member.

In some engine designs the block has an annular shelf that surrounds the cylinder liner and controls coolant flow past the cylinder liner near the piston ring upper turn around area. One example of such an engine design is disclosed in U.S. Pat. No. 3,800,751 issued to S. F. Glassey et al. on Apr. 2, 1974 and assigned to the Assignee of the present invention. An annular venturi throat is defined between the cylinder liner and the shelf to increase the velocity and turbulence of the coolant past the shelf thereby obtaining a more rapid transfer of heat to the cooling fluid. The most effective cooling of the cylinder liner occurs along the axial length of the shelf. Undesirably, however, the shelf may not be properly located or have sufficient cooling length to accommodate different designs of pistons and elevated combustion chamber pressures.

Current and future governmental emission regulations and industry wide performance standards necessitates minimizing the piston to cylinder crevice volume. This volume is defined as that upper area along the perimeter of the piston and includes down to the top piston ring. If the crevice volume is large there is a substantial quantity of combustion gas that is not properly burned because the material is entrapped in a dead air space between the piston member and the cylinder bore. Reducing the crevice volume is a factor in lowering fuel consumption and emissions.

U.S. Pat. No. 4,941,440 issued to R. L. Weber et al. on Jul. 17, 1990 and assigned to the Assignee of the present invention discloses a high output articulated piston assembly. The piston assembly can be used to convert or upgrade engines like that shown in U.S. Pat. No. 3,800,751 to increase horsepower and reduce fuel consumption and emissions. The piston assembly is capable of continuous and efficient operation at combustion chamber pressures above about 15,170 kPa (2,200 psi). The piston features a high top ring location to minimize the crevice volume above the top ring, however, with the elevated top ring the ring travels beyond the most effective cooling area of the coolant shelf Consequently, there is a need to remove the increasing heat experienced thereat so as to obviate oil degradation, carbon packing in the ring area, and piston seizure In many instances, however, it is not feasible or economically practical to make a major change to the engine block to raise or expand the axial length of the annular coolant shelf.

Thus, what is needed is a simple economical means of expanding the axial length of the most effective cooling area of the liner above the existing coolant shelf without changing the existing block construction. Preferably, the means should provide increased heat transfer from the cylinder liner and piston to the cooling fluid within the cooling chamber to reduce the temperature of the cylinder liner and piston specifically in the area of the top piston ring turn around area.

The present invention is directed to overcoming one or more of the problems as set forth above.

DISCLOSURE OF THE INVENTION

In one aspect of the present invention, an internal combustion engine has a block defining a bore, a cylinder liner located in the bore and cooperating therewith to define upper and lower, axially spaced, annular coolant chambers. The internal combustion engine advantageously includes means defining a plurality of circumferentially spaced elongate passages communicating the lower coolant chamber with the upper coolant chamber.

In another aspect of the invention, an internal combustion engine includes a block defining a bore, a cylinder liner located in the bore, and upper and lower, axially spaced, annular coolant chambers adapted in use to receive a liquid coolant. Sleeve means is disposed between the upper and lower coolant chambers and includes means defining a plurality of circumferentially spaced passages to communicate the lower coolant chamber with the upper coolant chamber and to control the flow rate of the coolant being communicated between the upper and lower coolant chambers.

In a further aspect of the invention, a cylinder liner is adapted for use in an internal combustion engine and comprises sleeve means and means defining a plurality of coolant passages disposed radially inwardly of the sleeve means.

BRIEF DESCRIPTION OF THE DRAWINGS

FIG. 8 is an enlarged fragmentary portion of the top peripheral region of an alternate embodiment of the cylinder liner with portions broken away: and FIG. 9 is an enlarged cross-sectional view of a portion of the cylinder liner cooling shown in FIG. 7 taken along line 9—9 thereof.

BEST MODE FOR CARRYING OUT THE INVENTION

Figure 1:
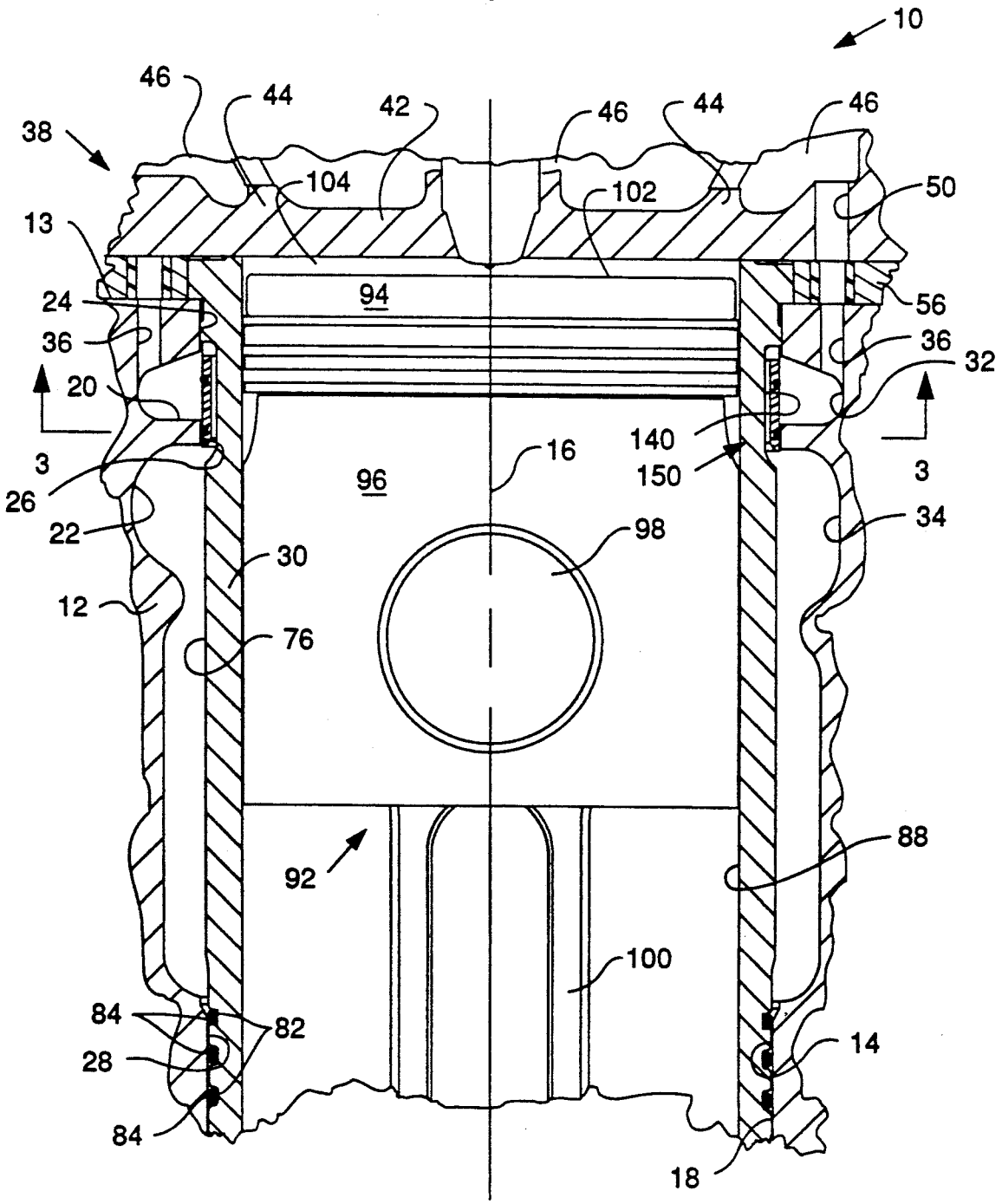
FIG. 1 is a diagrammatic, fragmentary, transverse vertical section view of a cylinder liner and a coolant sleeve operatively assembled in an internal combustion engine in accordance with the present invention.
Figure 2:
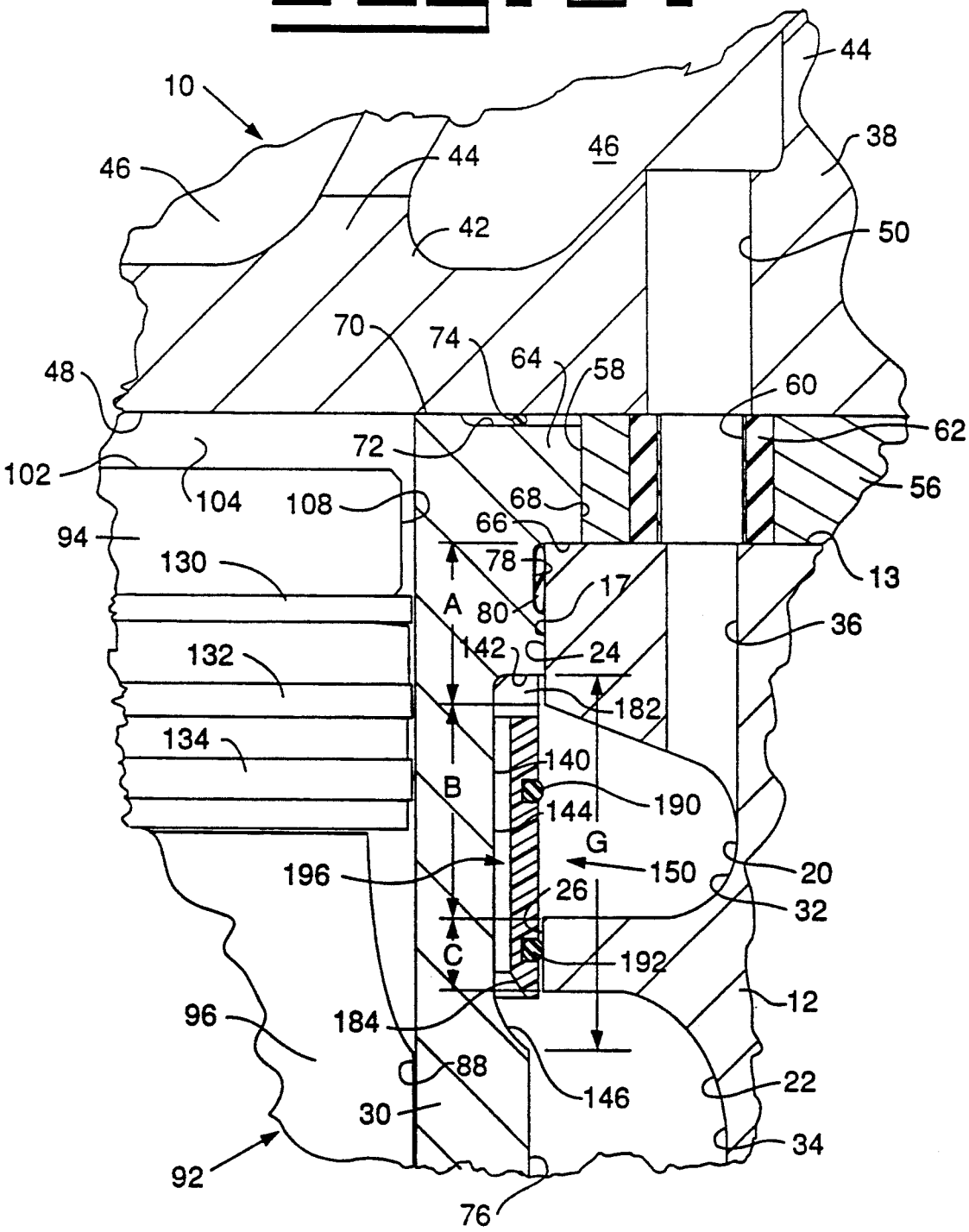
FIG. 2 is an enlarged fragmentary portion of the top peripheral region of the cylinder liner and the coolant sleeve shown in FIG. 1 to better show details of construction thereof.
Figure 3:
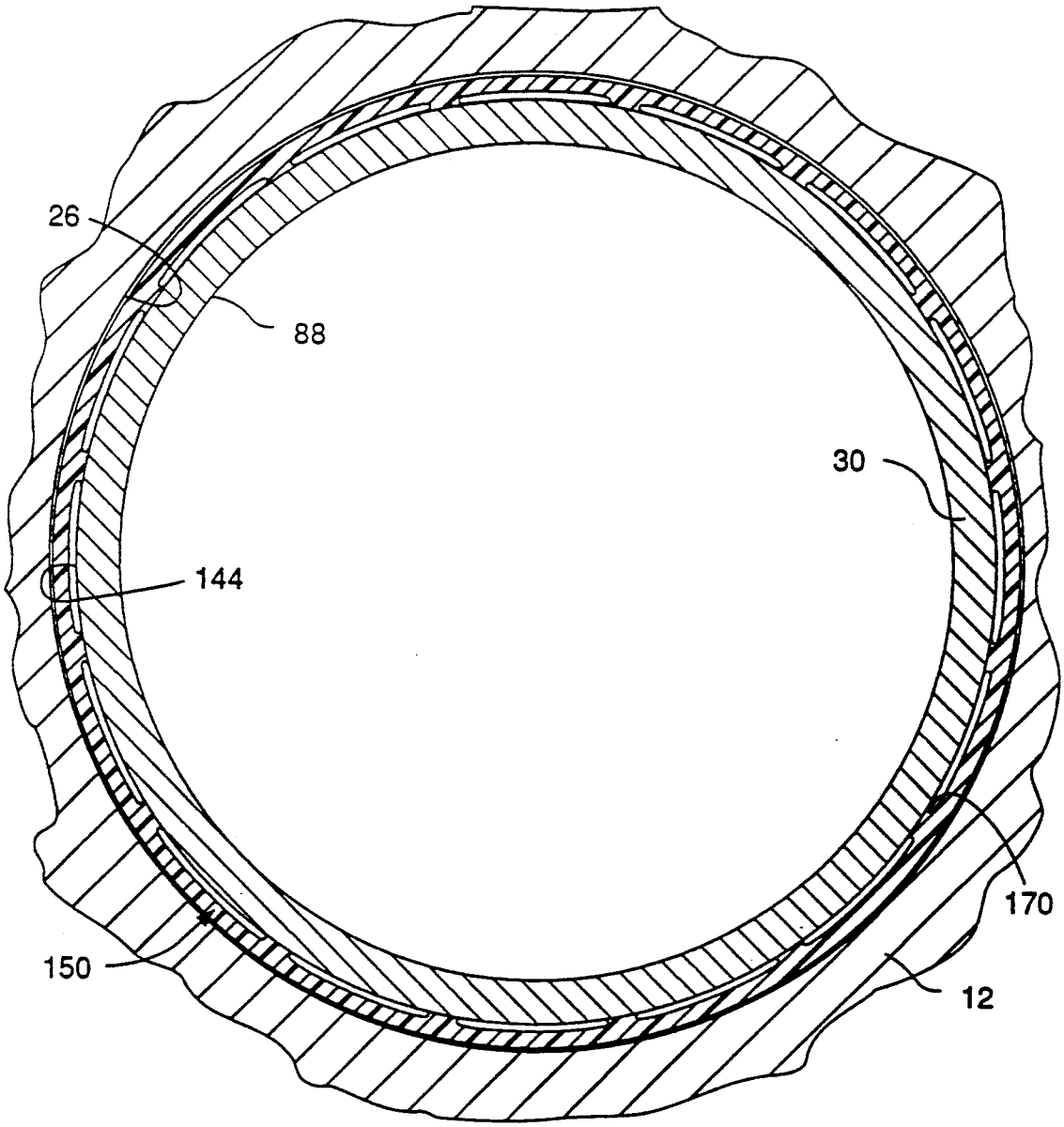
FIG. 3 is a cross sectional view solely of the cylinder liner, coolant sleeve, and engine block shown in FIG. 1 as taken in the direction of arrows 3—3.

FIGS. 1 and 2 illustrate a portion of an internal combustion engine 10. The engine 10 including a block 12 having, as viewed in FIG. 1, an upper mounting and sealing surface 13 and a plurality of generally upright cylinder bores 14 (one shown) suitably formed therein. Each cylinder bore 14 has a central axis 16, an upper portion 17 that has a preselected diameter, and a lower portion 18 that has a preselected diameter. The upper portion 17 of the cylinder bore 14 in this specific instance is of a greater diameter than the lower portion. An upper annular recess 20 and a lower annular recess 22 are defined in the block 12. The upper annular recess 20 and the lower annular recess 22 are axially aligned with and communicates with the cylinder bore 16 so as to define a top block land 24, an intermediate land or shelf 26, and a bottom block land 28. As shown in FIG. 2 the top block land 24 extends downward from the upper mounting surface 14 and has a preselected axial length A. The upper annular recess 20 has a preselected axial width B and the shelf 26 has a preselected axial length C.

The upper and lower annular recesses 20 and 22 cooperate with a hereafter described cylinder liner 30 to define a pair of upper and lower, axially spaced, annular coolant chambers 32 and 34 which circumscribe the cylinder liner. The upper and lower coolant chambers 32 and 34 are adapted in use to receive a liquid coolant for cooling purposes. The block 12 further defines, in this specific instance, eight block coolant passages 36, two of which are shown. The block cooling passages 36 are circumferentially and equally spaced axially around the cylinder bore 14 and extend from the upper cooling chamber 32 to the upper mounting surface 13.

A cylinder head 38 includes a bottom wall 42 and a plurality of side walls 44 which define head cooling chambers 46 therein (two shown). The bottom wall 42 defines a bottom sealing and mounting surface 48 thereunder. The bottom wall 42 further defines, in this specific instance, eight radially disposed head coolant passages 50, two of which are shown, that communicate with the head cooling chambers 46.

A spacer plate 56 is sandwiched between the mounting surfaces 13 and 48 of the block and cylinder head 12 and 38 respectively. The spacer plate 56 defines a generally cylindrical opening 58 spaced radially outward of the cylinder bore 14 and eight radially disposed spacer passages 60, two of which are shown. A sleeved coolant seal 62 is sealingly disposed in each of the spacer passages 60. The coolant seals 62 are in alignment with the block coolant passages 36 and the head coolant passages 50 to continuously communicate coolant from the upper coolant chamber 32 to the head coolant chambers 50.

The cylinder liner 30 in the specific instance is cast iron. The cylinder liner 30 as best shown in FIG. 2, is sealingly disposed in the cylinder bore 14 and supported on the upper mounting surface 13 of the engine block 12 by a continuous upper, radial support flange 64 having a lower surface 66. The support flange 64 has an outer peripheral flange surface 68 that is piloted in the cylindrical opening 58 in the spacer plate 56. A top surface 70 and a radially outwardly extending annular recess 72 are defined by the upper end of the cylinder liner 30 so as to receive a compressible fire ring 74. The fire ring 74 is sealingly entrapped between the radially outwardly extending annular recess 72 and the bottom mounting surface 48 of the cylinder head 38.

The cylinder liner 30 comprises an outer peripheral liner surface 76 that is stabilizingly supported by the top and bottom lands 24 and 28 of the block 12. As shown in FIG. 2, an upper seal annular recess 78 is defined in the liner surface 76 immediately below the support flange 64 so as to receive an upper elastomeric seal ring 80 which, in use, sealingly engages the top land 24. As shown in FIG. 1, a plurality of annular lower recesses 82, three in the specific instance, are defined in the lower end of the outer peripheral liner surface 76 of the cylinder liner 30 so as to receive a plurality of lower elastomeric seal rings 84 which, in use, sealingly engages the bottom land 28.

The cylinder liner 30 defines a cylindrical liner bore 88 therethrough with a central axis coaxial with the central axis 16 of the cylinder bore 14. A piston assembly 92 is reciprocally mounted in the liner bore 88. The piston assembly 92 is shown in its uppermost or ring turn around position in FIGS. 1 and 2. The piston assembly 92 in this specific application, includes an upper steel piston member 94 and a lower aluminum piston skirt 96 which are articulately mounted on a common wrist pin 98. A conventionally connection rod 100 is operationally connected to, and driven by the wrist pin 98. The piston member 94 has a peripheral top surface 102 that is located on a plane perpendicular to the central axis 16. As best shown in FIG. 1, the circular region located immediately above the piston member 94 and below the mounting surface 48 of the cylinder head 38 when the piston assembly 92 is disposed at top dead center is known as a combustion chamber 104.

As best shown in FIG. 2, the piston member 4 further includes an outer peripheral piston surface 108 that depends from the outer edge of top surface 102. A top compression ring 130, an intermediate compression ring 132, and a bottom oil ring 134 are positioned in respective conventional ring grooves defined in the outer peripheral piston surface 108. The elevational distance between the top surface 102 of the piston member 94 and the top compression ring 130 in this example is relatively short as compared to other pistons in order to reduce the piston to cylinder crevice volume.

As shown in FIGS. 1 and 2, an annular cylinder liner groove 140 is defined in the outer peripheral liner surface 76 of the cylinder liner 30. The liner groove 140 may be produced in a conventional manner, such as being cast in situ or machined. As best shown in FIG. 2, the liner groove 140 has a preselected width G and is located generally adjacent to the upper annular recess 20 and the shelf 26 of the block 12. The liner groove 140 has an upper annular shoulder 142 that is generally perpendicular to the outer peripheral surface 76, a bottom peripheral surface 144 spaced radially inward from the outer peripheral surface, and a lower annular arcuate shoulder 146. The arcuate shoulder 146 is located below the shelf 26. The upper shoulder 142 is located a preselected axial distance from the upper mounting surface 13 of the block 12 that is equal to or less than the preselected axial length A of the top block land 24. The preselected width G of the liner groove 140 is greater than the combined preselected axial width B of the upper annular recess 20 and the preselected length C of the shelf 26.

A split sleeve 150 is located in the liner groove 140, disposed between the upper and lower coolant chambers 32 and 34, and extending into the upper chamber 32. As best shown in FIGS. 2, 3, 4, 5 and 6 the split sleeve 150 includes a pair of generally parallel first and second sleeve end walls 162 and 164 defining a predetermined width W, and a pair of generally parallel inner and outer peripheral surfaces 166 and 168. The split sleeve 150 has a cross-section that is generally rectangular. The outer peripheral surface 168 defines an outer diameter of a preselected dimension. In this example, the outer diameter of the split sleeve 150 is slightly smaller than the diameter of the upper top land 24 and the shelf 26.

Figure 5:
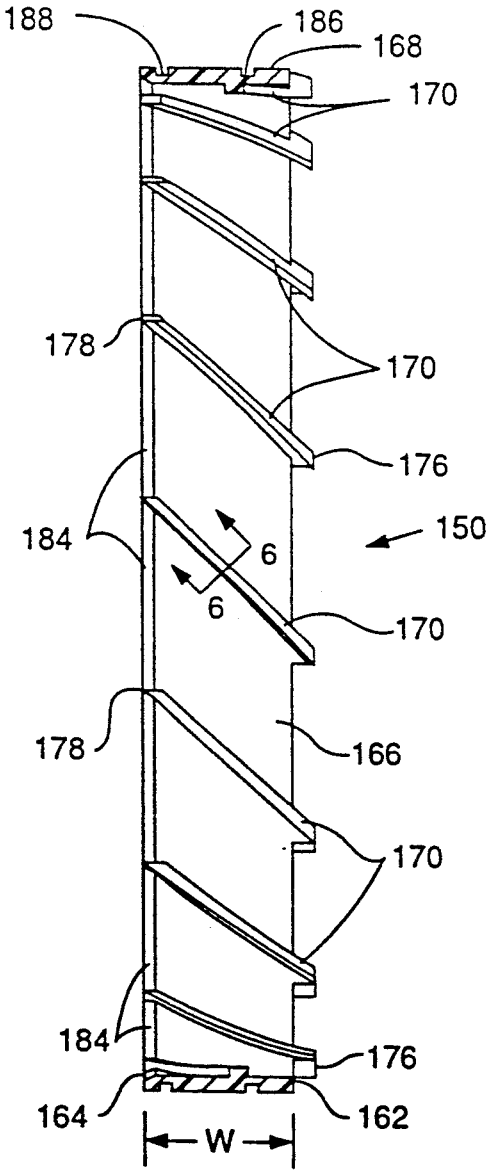
FIG. 5 is an enlarged cross-sectional view of the coolant sleeve.
Figure 6:
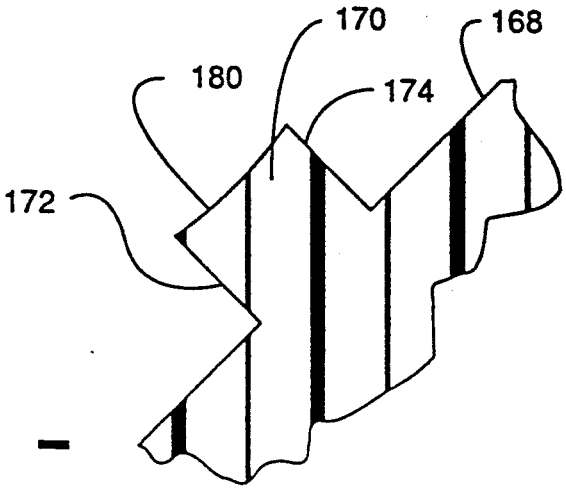
FIG. 6 is an enlarged cross-sectional view of a cooling vane shown in FIG. 5 taken along line 6—6 thereof.

A plurality of generally parallel, oblique cooling vanes 170 extend generally radially inwardly from the inner surface 166 a predetermined distance. Preferably as shown in FIG. 5 and 6, the cooling vanes 170 have a pair of generally parallel side walls 172 and 174, a pair of first and second vane end walls 176 and 178, and a concave inner surface 180. The inner surface 180 conforms generally to the bottom surface 144 of the liner groove 140 and seated thereon. In this specific instance, there are sixteen equally spaced cooling vanes 170, each cooling vane being disposed at an angle of approximately 45 degrees with respect to the axial centerline 18 of the cylinder bore 16. It is recognized that the number of the cooling vanes 170 may be more or less and that cooling vanes may be disposed at other angles and heights suitable for specific cooling conditions. The cooling vanes 170 are spaced on the inner surface 166 so as to not circumferentially overlap one another.

Each vane 170 extends axially outwardly past the first sleeve end wall 162 a preselected distance, with the first vane end walls 176 being in contact with the annular shoulder 142 of the liner groove 140. The first vane end wall 176 forms a stop surface limiting upward movement of the split sleeve 150. As shown in FIG. 2, the cooling vanes 170 cooperate with the first sleeve end wall 162 to define a plurality of radially extending grooves or passages 182. The second sleeve end wall 164 includes a plurality of angled surfaces 184 individually defined between the adjacent cooling vanes 170.

Figure 4:
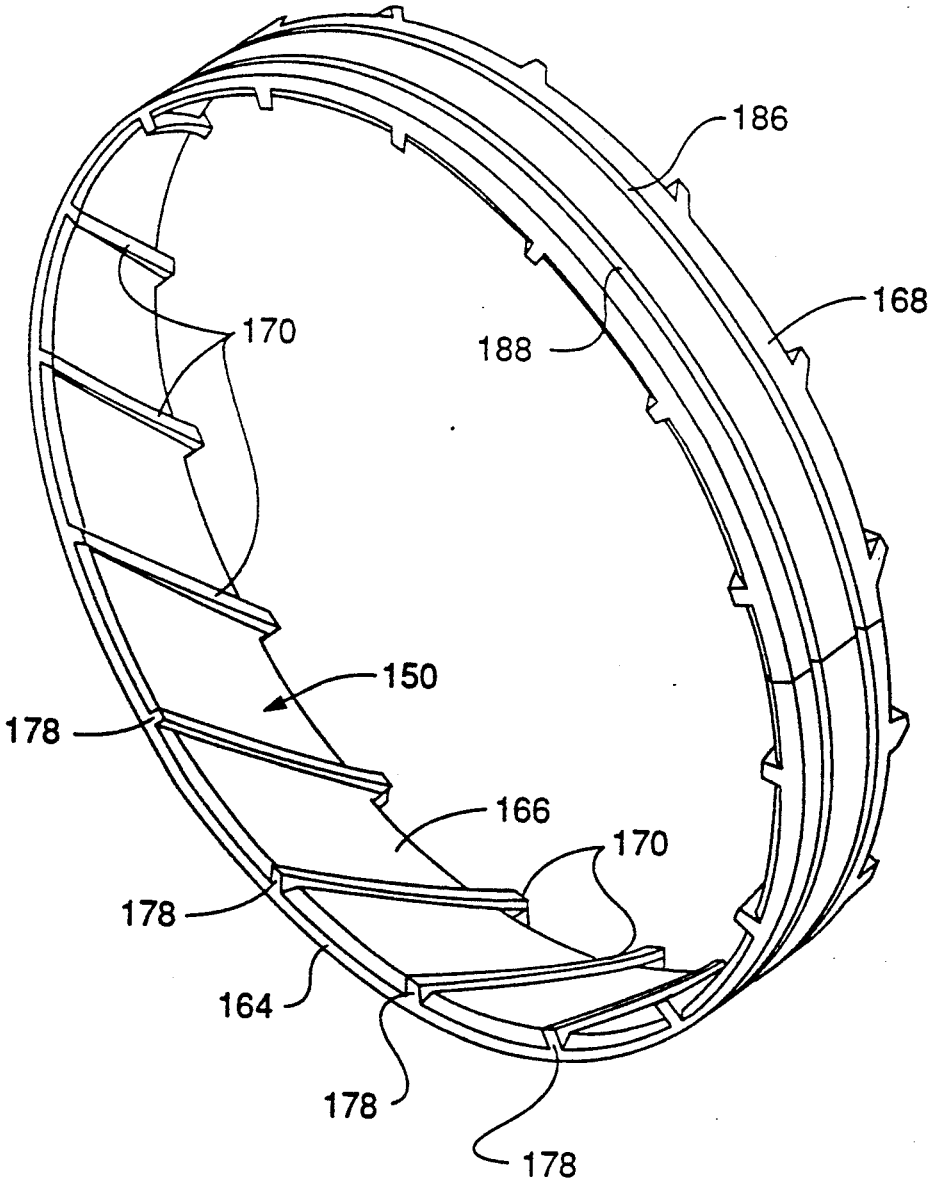
FIG. 4 is an enlarged, diagrammatic, perspective view of the coolant sleeve shown in FIG. 1.

As best shown in FIGS. 2, 4, and 5, an upper annular sleeve ring groove 186 is defined in the outer peripheral surface 168 of the split sleeve 150 adjacent the first end walls 162 and a lower annular sleeve ring groove 188 is defined in the outer peripheral surface adjacent the second end wall 164. A first elastomeric ring 190 is received in the upper sleeve ring groove 186 and a second elastomeric ring 192 is received in the lower sleeve ring groove 188. The second elastomeric ring 192 in this specific instance, is in sealing engagement with the shelf 26, however, in some applications such sealing contact may not be required. As an alternative, a single annular sleeve ring groove with a single elastomeric ring could be used without departing from the gist of the invention.

The split sleeve 150 and the cylinder liner 30 define a plurality of circumferentially spaced passages or venturi throats 196 adapted to communicate the lower coolant chamber 34 with the upper coolant chamber 32. For example, in this application each venturi throat 196 is further defined by the inner surface 166, the sidewalls 172 and 174 of the cooling vanes 170, and the upper annular shoulder 142, and the bottom surface 144 of the cylinder liner groove 140.

Figure 7:
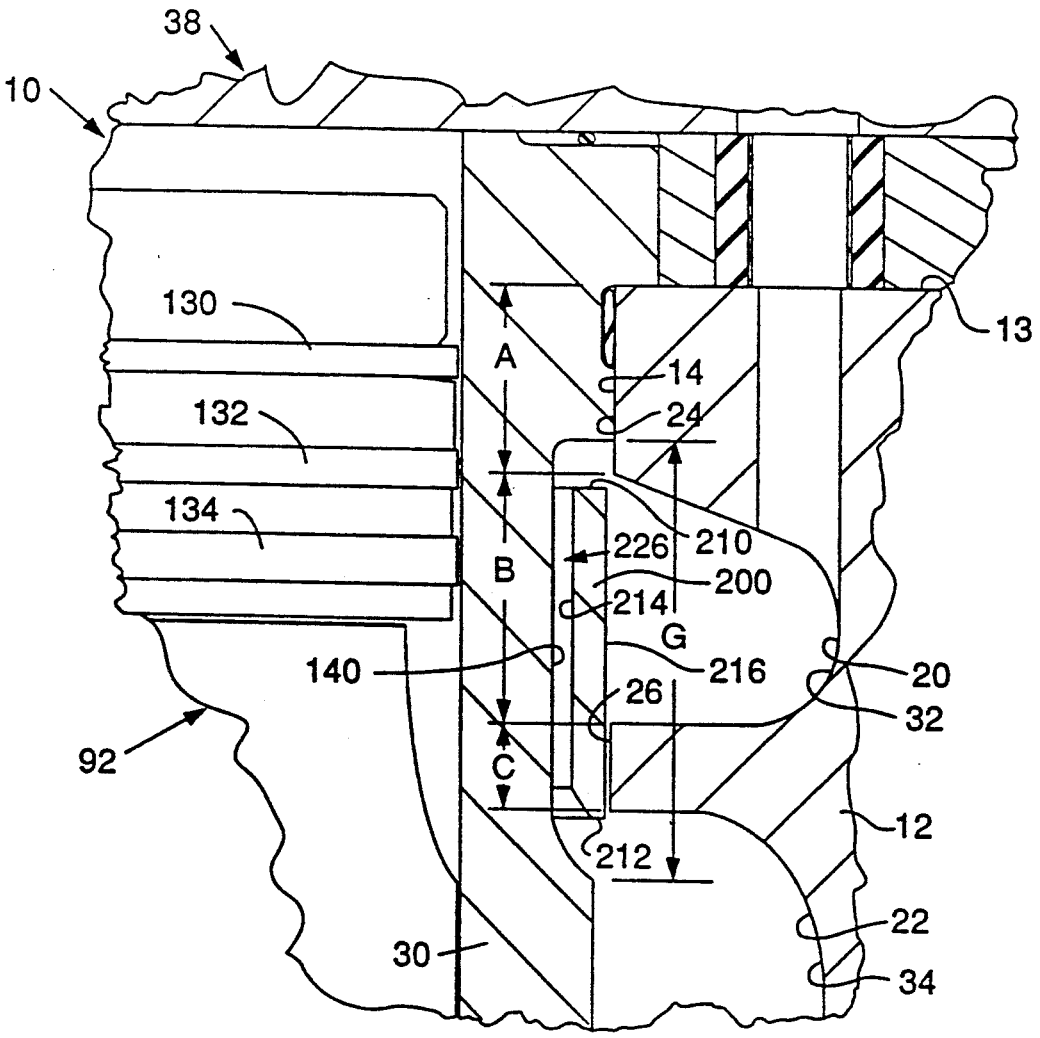
FIG. 7 is an enlarged fragmentary portion of the top peripheral region of an alternate embodiment of the cylinder liner.

Referring now to FIG. 7, 8, and 9, an alternate embodiment is illustrated with similar elements thereof being identified by the same reference numbers. In this embodiment, a sleeve 200 is cast integrally with the cylinder liner 30. The sleeve 200 is located in the groove 140, disposed between the upper and lower coolant chambers 32 and 34, and extending into the upper chamber 32. The sleeve 200 includes a pair of generally parallel first and second sleeve end walls 210 and 212 defining a predetermined width W', and a pair of generally parallel inner and outer peripheral surfaces 214 and 216. The outer peripheral surface 216 defines an outer diameter, which in this example is slightly smaller than the diameter of the top land 24 and the shelf 26. The sleeve 200 has a cross-section is generally rectangular.

A plurality of generally parallel oblique cooling vanes 220 extend between the inner surface 214 of the sleeve 200 and the bottom surface 144 of the cylinder liner groove 140. Preferably, as shown in FIG. 8 and 9, the cooling vanes 220 have a pair of generally parallel side walls 222 and 224. In this specific instance, there are sixteen equally spaced cooling vanes 220, each vane being disposed at an angle of approximately 45 degrees with respect to the axial centerline 18 of the cylinder bore 16. It is recognized that the number of the cooling vanes 220 may be more or less and that the cooling vanes may be disposed at other angles and heights suitable for specific cooling conditions. In this example, the cooling vanes 220 are circumferentially spaced so as to not overlap one another.

The sleeve 200 and the cylinder liner 30 define a plurality of circumferentially spaced passages or venturi throats 226 adapted to communicate the lower coolant chamber 34 with the upper coolant chamber 32. For example, in this application each venturi throat 226 is further defined by the inner surface 214 of the sleeve 200, the sidewalls 222 and 24 of the cooling vanes 220, the upper annular shoulder 142, and the bottom surface 144 of the cylinder liner groove 140.

Industrial Applicability

The unique coolant sleeves 150 and 200 in this invention is used to expand the effective axial length of the cooling area around the cylinder liner 30 of an internal combustion engine 10 without changing the existing block 12 construction. The most effective cooling area around the cylinder liner 30 is the area where the velocity of the coolant is increased and the flow of the coolant is directly adjacent the cylinder liner. The subject invention improves the cooling capability of the engine 10 when using, for example, the high output piston assembly 92 with the top piston ring 130 located relatively close to the top surface 102 of the piston member 94 to minimize the crevice volume above the top ring.

Referring to FIGS. 1 and 2, each cylinder bore 14 is fitted with the cylinder liner 30 and the split sleeve 150. During operation of the engine 10, coolant circulates around the cylinder liner 30, passing from the lower coolant chamber 34 through the plurality of circumferentially spaced elongate venturi throats 196 and the passages 182 to the upper coolant chamber 32. The venturi throats 196 provide a relatively long flow path and controls the flow rate of the coolant being communicated from the lower coolant chamber 34 to the upper coolant chamber 32 in order to dissipate heat away from the cylinder liner 30 and piston assembly 92 in the upper ring turn around area. The coolant exits the upper coolant chamber 32 through the block coolant passages 36 and the sleeved coolant seal 62 to the head coolant passages 50 communicating with the head cooling chambers 50. As a result of the split sleeve 150 being disposed between the upper and lower coolant chambers 32 and 34 and extending into the upper chamber 32, the effective axial length of the cooling area around the cylinder liner 30 is expanded.

The venturi throats 196 increase the turbulence and velocity of coolant flow from the lower coolant 32 to the upper coolant chamber 34 and circulates the coolant directly adjacent the bottom peripheral surface 144 of the liner groove 140 providing a more rapid transfer of heat to the cooling fluid. Desirably, the velocity of the coolant through the venturi throats 196 should be in the range of 1.68 to 3.05 meters per second (5½ to 10 feet per second) for the most effective cooling.

With the cooling vanes 170 disposed at an angle of approximately 45 degrees with respect to the axial centerline 18 of the cylinder bore 16 heat transfer to the coolant is improved by providing a relative long flow path. The cooling vanes 170 are circumferentially spaced so as to not overlap one another to insure that no axial barrier is created to the flow of the coolant. Furthermore, by not having any overlap between the cooling vanes 170, the ability to injection mold the split sleeve 150 is made easier since the mold can be easily separated in a conventional manner.

In use, the first vane end walls 176 of the split sleeve 150 are in contact with the upper annular shoulder 142 of the cylinder liner groove 140. Each of the passages 182 is of a size sufficient to provide unrestricted fluid flow through the venturi throats 196 to the upper coolant chamber 32. Consequently, due to the extension of the cooling vanes 170, the coolant flow from the venturi throats 196 through the passages 182 can not be further restricted or closed off. Furthermore, the coolant flow entering the venturi throats 196 also impinges on the second sleeve end wall 164 of the sleeve 152 and produces a force urging the first vane end wall 176 against the shoulder 142.

The elastomeric rings 190 and 192 bands together the split sleeve 150 and retains it in the cylinder liner groove 140. As a secondary advantage the elastomeric ring 192 located adjacent the second end wall 164 may sealingly engage with the shelf 26. However, a sealing relationship between the elastomeric ring 192 and the shelf 26 is not a necessity provided the radial clearance between the split sleeve 150 and the shelf is keep to a minimum. In this specific instance, the elastomeric rings 190 and 192 are o-rings made from neoprene but alternatively the rings could be metallic garter springs. Alternatively, the split sleeve 150 could be constructed of two or more sections without departing from the spirit of the invention.

The split sleeve 150 is preferably constructed from a temperature and corrosive resistant material selected from the polyamide (NYLON) family of thermoplastic resins, such as polyether sulfone, manufactured by LNP Engineering Plastics, Inc. of Exton, PA., and polyether etherketone (VICTREX D150CA30) manufactured by Imperial Chemical Industries of Exton, PA. (VICTREX is a registered trademark of Imperial Chemical industries). The preferred polyether sulfone is 30% glass reinforced having superior dimensional stability and resistance to heat. Such materials have the ability to withstand corrosive liquids and an engine operating temperature of approximately 200 degrees C. (400 degrees F.).

In the embodiment of FIG. 7, 8, and 9, the sleeve 200 is cast integral with the cylinder liner 30, for example by the lost foam or investment casting process. The plurality of generally parallel cooling vanes 220 are cast integral with the inner surface 214 of the sleeve 200 and the bottom surface 144 of the liner groove 140. As in the preceding embodiment, the cooling vanes 220 are disposed at an angle of approximately 45 degrees with respect to the axial centerline 18 of the cylinder bore 16. The venturi throats 226 provides a relatively long flow path and controls the flow rate for the coolant being communicated from the lower coolant chamber 34 to the upper coolant chamber 32 in order to dissipate heat away from the cylinder liner 30 and piston assembly 92 in the upper piston ring turn around area.

Other aspects, objects, and advantages of this invention can be obtained from a study of the drawings, the disclosure, and the appended claims.

I claim:

1. An internal combustion engine comprising:

a block defining a cylinder bore, an upper annular recess, and a lower annular recess;

a cylinder liner having a central axis located in the cylinder bore and cooperating with the upper and lower annular recesses to define upper and lower, axially spaced, annular coolant chambers; and a sleeve being disposed between the upper and lower coolant chambers, extending into the upper coolant chamber, and surrounding the cylinder liner, the sleeve and the cylinder liner defining a plurality of circumferentially spaced venturi throats adapted to communicating the lower coolant chamber with the upper coolant chamber.

2. The internal combustion engine of claim 1 wherein the venturi throats are disposed obliquely with respect to the central axis of the cylinder liner.

3. The internal combustion engine of claim 2 wherein the block includes an upper mounting surface, the upper annular recess having a preselected axial length B and the upper annular recess communicating with the cylinder bore to define a top block land that extends downward from the upper mounting surface a preselected axial length A, an intermediate shelf.

4. The internal combustion engine of claim 3 wherein the cylinder liner comprises an outer peripheral surface and a liner groove having a preselected width G is defined in the outer peripheral surface and the sleeve is disposed in the liner groove.

5. The internal combustion engine of claim 4 wherein the liner groove is located generally adjacent the upper annular recess and the shelf of the block.

6. The internal combustion engine of claim 5 wherein the preselected width G of the liner groove is greater than the combined preselected axial width B of the upper annular recess and the preselected length C of the shelf.

7. The internal combustion engine of claim 6 wherein the liner groove has an upper annular shoulder that is generally perpendicular to the outer peripheral surface of the cylinder liner, a bottom peripheral surface, and a lower annular arcuate shoulder.

8. The internal combustion engine of claim 7 wherein the lower arcuate shoulder is located below the shelf and the upper annular shoulder is located a preselected axial distance from the upper mounting surface that is equal to or less than the preselected axial length A of the top land.

9. The internal combustion engine of claim 8 wherein the sleeve includes a pair of parallel first and second end walls defining a preselected width W, a pair of generally parallel inner and outer peripheral surfaces, and a plurality of generally parallel oblique vanes extending generally radially from the inner surface, the oblique vanes each have a pair of generally parallel side walls, a pair of first and second vane end walls, and a concave inner surface, the inner surface conforms generally to the bottom surface of the liner groove and seated thereon.

10. The internal combustion engine of claim 9 wherein there are sixteen equally spaced oblique vanes and each oblique vane being disposed at an angle of approximately 45 degrees with respect to the central axis of the cylinder bore.

11. The internal combustion engine of claim 9 wherein the oblique vanes are spaced on the inner surface so as to not circumferentially overlap one another.

12. The internal combustion engine of claim 9 wherein the oblique vanes extends axially outwardly past the first sleeve end wall a preselected distance, with the first vane end walls being in contact with the annular shoulder of the liner groove, and the first vane end walls forms a stop surface limiting upward movement of the sleeve, the cooling vanes cooperate with the first sleeve end wall to define a plurality of radially extending grooves.

13. The internal combustion engine of claim 12 wherein each venturi throat includes the inner surface of the sleeve, the sidewalls of the cooling vanes, and the upper annular shoulder and the bottom surface of the cylinder liner groove.

14. The internal combustion engine of claim 9 wherein the sleeve is constructed from polyether etherketone.

15. The internal combustion engine of claim 9 wherein at least one annular sleeve ring groove is defined in the outer peripheral surface and at least one elastomeric ring is received in the at least one annular sleeve ring grooved for retention of the sleeve in the liner groove.

16. The internal combustion engine of claim 15 wherein the elastomeric ring sealing engages the shelf.

17. The internal combustion engine of claim 9 wherein the sleeve is constructed from polyether sulfone.

18. The internal combustion engine of claim 1 wherein the sleeve is cast integral with the cylinder liner.

19. The internal combustion engine of claim 18 wherein the sleeve includes a pair of parallel first and second end walls defining a preselected width W', a pair of generally parallel inner and outer peripheral surfaces, and a plurality of generally parallel oblique vanes extending between the inner surface of the sleeve and the bottom surface of the liner groove, each of the oblique vanes having a pair of generally parallel side walls.

20. The internal combustion engine of claim 19 wherein there are sixteen equally spaced oblique vanes and each oblique vane being disposed at an angle of approximately 45 degrees with respect to the central axis of the cylinder bore.

21. The internal combustion engine of claim 19 wherein the oblique vanes are spaced on the inner surface so as to not circumferentially overlap one another.

22. The internal combustion engine of claim 19 wherein each venturi throat includes the inner surface of the sleeve, the sidewalls of the cooling vanes, and the bottom surface of the cylinder liner groove.

23. A cylinder liner having a central axis adapted for use in an internal combustion engine, wherein the improvement comprises:

the cylinder liner having an outer peripheral surface and a liner groove defined in the outer peripheral surface; and a sleeve being disposed in the liner groove and surrounding the cylinder liner, the sleeve and the cylinder liner defining a plurality of circumferentially spaced elongated venturi throats disposed between the sleeve and the liner groove.

24. A cylinder liner of claim 23 wherein the venturi throats are disposed obliquely with respect to the central axis of the cylinder liner.

25. The cylinder liner of claim 23 wherein the liner groove has an upper annular shoulder that is generally perpendicular to the outer peripheral surface, a bottom peripheral surface, and a lower annular arcuate shoulder.

26. The cylinder liner of claim 25 wherein the sleeve includes a pair of parallel first and second end walls, a pair of generally parallel inner and outer peripheral surfaces, and a plurality of generally parallel oblique vanes extending generally radially from the inner surface, the oblique vanes have a pair of generally parallel side walls, a pair of first and second vane end walls, and a concave inner surface, the inner surface conforms generally to the bottom surface of the liner groove and seated thereon.

27. The cylinder liner of claim 26 wherein there are sixteen equally spaced oblique vanes and each oblique vane being disposed at an angle of approximately 45 degrees with respect to the axial centerline of the cylinder bore.

28. The cylinder liner of claim 25 wherein the oblique vanes are spaced on the inner surface so as to not circumferentially overlap one another.

29. The cylinder liner of claim 25 wherein at least one annular sleeve ring groove is defined in the outer peripheral surface and at least one elastomeric ring is received in the at least one annular sleeve ring groove for retention of the sleeve in the liner groove.

30. The cylinder liner of claim 25 wherein venturi throat includes the inner surface of the sleeve, the sidewalls of the oblique vanes, and the upper annular shoulder and the bottom surface of the cylinder liner groove.

31. The cylinder liner of claim 30 wherein the sleeve includes a pair of parallel first and second end walls defining a preselected width W', a pair of generally parallel inner and outer peripheral surfaces, and a plurality of generally parallel oblique vanes extending between the inner surface of the sleeve and the bottom surface of the liner groove, the oblique vanes having a pair of generally parallel side walls.

32. The cylinder liner of claim 23 wherein the sleeve is constructed from polyether sulfone.

33. The cylinder liner of claim 23 wherein the sleeve is constructed from polyether etherketone.

34. The cylinder liner of claim 23 wherein the sleeve is cast integral with the cylinder liner.

35. The cylinder liner of claim 34 wherein each venturi throat includes the inner surface of the sleeve, the sidewalls of the oblique vanes, and the bottom surface of the cylinder liner groove.

* * * * *